US005881964A

United States Patent [19]

Fujikura et al.

[11] Patent Number: 5,881,964

[45] Date of Patent: Mar. 16, 1999

[54] WEB SPLICING APPARATUS HAVING OFFSET SPLICING AND TAPING

[75] Inventors: Daisuke Fujikura; Minoru Takahashi, both of Minami-ashigara, Japan

[73] Assignee: Fuji Photo Film Co., Ltd., Kanagawa, Japan

[21] Appl. No.: 861,935

[22] Filed: May 22, 1997

[30] Foreign Application Priority Data

May 24, 1996 [JP] Japan ..... 8-130100
Jun. 4, 1996 [JP] Japan ..... 8-141797

[51] Int. Cl.[6] ..... B65H 19/18

[52] U.S. Cl. ..... 242/556.1; 242/555.1; 242/562.1; 156/506; 226/92

[58] Field of Search ..... 242/556.1, 555.2, 242/555.1, 562.1; 156/502, 505, 506; 226/92

[56] References Cited

U.S. PATENT DOCUMENTS

| | | |
|---|---|---|
| 3,537,939 | 11/1970 | Delaplaine et al. . |
| 3,647,600 | 3/1972 | Vischulis et al. . |
| 3,654,035 | 4/1972 | Takimoto . |
| 3,717,057 | 2/1973 | Takimoto . |
| 3,939,031 | 2/1976 | Takimoto . |
| 4,450,039 | 5/1984 | Salvucci et al. . |
| 4,564,149 | 1/1986 | Barzano . |
| 4,636,276 | 1/1987 | Nozaka . |
| 5,066,345 | 11/1991 | Long et al. . |
| 5,348,793 | 9/1994 | Stettner . |
| 5,381,983 | 1/1995 | Sakano et al. . |
| 5,385,622 | 1/1995 | Klingebiel . |
| 5,676,792 | 10/1997 | Cairns . |
| 5,783,028 | 7/1998 | Kunimoto . |

FOREIGN PATENT DOCUMENTS

| | | |
|---|---|---|
| 0 606 116 | 7/1994 | European Pat. Off. . |
| 0 680 910 | 11/1995 | European Pat. Off. . |
| 48-38461 | 11/1973 | Japan . |
| 61-90954 | 5/1986 | Japan . |
| 63-3819 | 1/1988 | Japan . |

*Primary Examiner*—Donald P. Walsh
*Assistant Examiner*—William A. Rivera
*Attorney, Agent, or Firm*—Young & Thompson

[57] ABSTRACT

A splicing tape supply device is composed of a main body for supplying splicing tape to a splicing drum and a moving mechanism for moving the main body. The main body is provided with a reel on which the splicing tape is wound, and the splicing tape is unwound from the reel and supplied to the splicing drum via a peel plate. The moving mechanism consists of a pair of rails and screw feeding equipment. An angle of inclination θ° of the rails is equal to an angle of inclination of a cutting line between two web ends, and the rails are inclined in the same direction of the cutting line. When the main body is moved along the rails, the splicing tape is supplied to the splicing drum at the angle of θ°. Thereby, the web ends, which are cut at a predetermined angle of inclination, can be satisfactorily spliced together with the splicing tape.

8 Claims, 14 Drawing Sheets

WEB SPLICING APPARATUS HAVING OFFSET SPLICING AND TAPING

BACKGROUND OF THE INVENTION

1. Field of the Invention

The present invention relates generally to a web splicing apparatus for splicing web materials, and more particularly to a splicing apparatus for splicing long flexible sheet materials such as plastic film, paper and foil (hereinafter referred to as a web) by splicing two ends of the webs of an old roll and a new roll while continuously supplying the web.

2. Description of the Related Art

U.S. Pat. No. 3,654,035 which corresponds to Japanese Patent Publication No. 48–38461 has disclosed an example of a conventional web splicing apparatus. This web splicing apparatus consists of a web turret, a web cutting and splicing means, and so forth.

The turret has a turret arm, and an old roll and a new roll are pivotally supported by two ends of the turret arm. The web is continuously supplied to the cutting and splicing means by changing the positions of the old roll and the new roll. The cutting and splicing means has a cutting drum and a splicing drum. The cutting drum cuts the trailing end of the web of the old roll, which is being unwound, and the leading end of the web of the new roll where the unwinding starts while continuously supplying the web. The splicing drum splices the web ends with splicing tape while continuously supplying the web.

The splicing tape must be supplied to the splicing drum in advance. Some of the conventional splicing tape supply devices have been disclosed in U.S. Pat. No. 4,636,276 which corresponds to Japanese Patent Publication No. 63-3819, Japanese Patent Provisional Publication No. 61-90954. The conventional splicing tape supply device supplies the splicing tape in a direction perpendicular to the longitudinal direction of the webs, and has a base assembly for supplying the splicing tape, a shifting mechanism for moving the base assembly in a direction perpendicular to the longitudinal direction of the webs.

As shown in FIG. 12, when a cutter 3 cuts a trailing end 1A of a web 1 of an old roll and a leading end 2A of a web 2 of a new roll while continuously supplying the webs 1 and 2, the ends 1A and 2A are cut at a predetermined angle of inclination θ° with respect to the longitudinal direction of the webs 1 and 2. The web ends 1A and 2A are spliced together by the above-mentioned splicing tape supply device. Since the supply device supplies the splicing tape 4 in a direction perpendicular to the longitudinal direction of the webs, the splicing tape 4 wrinkles as shown in FIG. 13, and the web ends 1A and 2A cannot be spliced together satisfactorily.

SUMMARY OF THE INVENTION

Accordingly, it is an object of the present invention to provide a splicing apparatus for splicing webs, which is capable of satisfactorily splicing the ends of webs which are cut at a predetermined angle of inclination.

To achieve the above-stated object, a splicing apparatus of the present invention comprises: a turret means for pivotally supporting an old roll from which one of the webs is unwound and a new roll from which the other of the webs starts to be unwound; a cutting means for cutting a trailing end of the web of the old roll and a leading end of the web of the new roll at a predetermined angle of inclination with respect to a width direction of the webs; a splicing means for splicing, with splicing tape, the ends of the webs, which are cut by the cutting means, along a cutting line between the ends of the webs; and a splicing tape supply means for supplying the splicing tape to the splicing means at an angle of inclination corresponding to the cutting line between the ends of the webs.

According to the invention, the splicing tape supply means supplies the splicing tape to the splicing means at an angle of inclination corresponding to the cutting line between two ends of the webs which are cut by the cutting means. Thereby, the splicing tape is put along the cutting line. Thus, the present invention is capable of splicing the ends of the webs, which are cut at a predetermined angle of inclination, without developing wrinkles on the splicing tape.

According to the invention, the splicing tape supply means consists of a main body for supplying the splicing tape to the splicing means, and a moving mechanism for moving the main body at an angle of inclination corresponding to the cutting line between the ends of the webs.

According to the invention, the moving mechanism of the splicing tape supply means consists of a rail which movably supports the main body at an angle of inclination corresponding to the cutting line between the ends of the webs, and a driving means for moving the main body along the rail.

According to the invention, the driving means of the splicing tape supply means is composed of screw feeding equipment.

According to the invention, the leading end of the web of the new roll is pinched over its width by a hold member, and the hold member is moved by a moving means so that the leading end of the web can be located at a position to be spliced by the splicing means. In the present invention, the end of the web is pinched over its width by the hold member, and thereby the web can be pinched tightly. The web can be transported without slipping from the transport position, and the leading end of the web can be smoothly transported from the new roll to the splicing position without fail.

According to the invention, a plurality of pins are provided on the hold member, and these pins bite into the leading end of the web. Thereby, the web can be prevented from slipping from the hold member.

According to the invention, the hold member consists of the first pinch member and a pair of the second pinch members. When the hold member holds the web, the pair of the second pinch members are opened and the first pinch member is positioned on one side of the web. Then, the first pinch member and the pair of the second pinch members pinch the web in a closed state, and fix members fix the first pinch member and the second pinch members. In this case, the pair of the second pinch members are openably provided at both ends of the first pinch member, and they are shorter than the first pinch member. For this reason, a space for opening and closing the pair of the second pinch members can be small, and in addition, the trouble for opening and closing the second pinch members can be reduced.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

This invention will be described in further detail by way of example with reference to the accompanying drawings.

Figure 1:
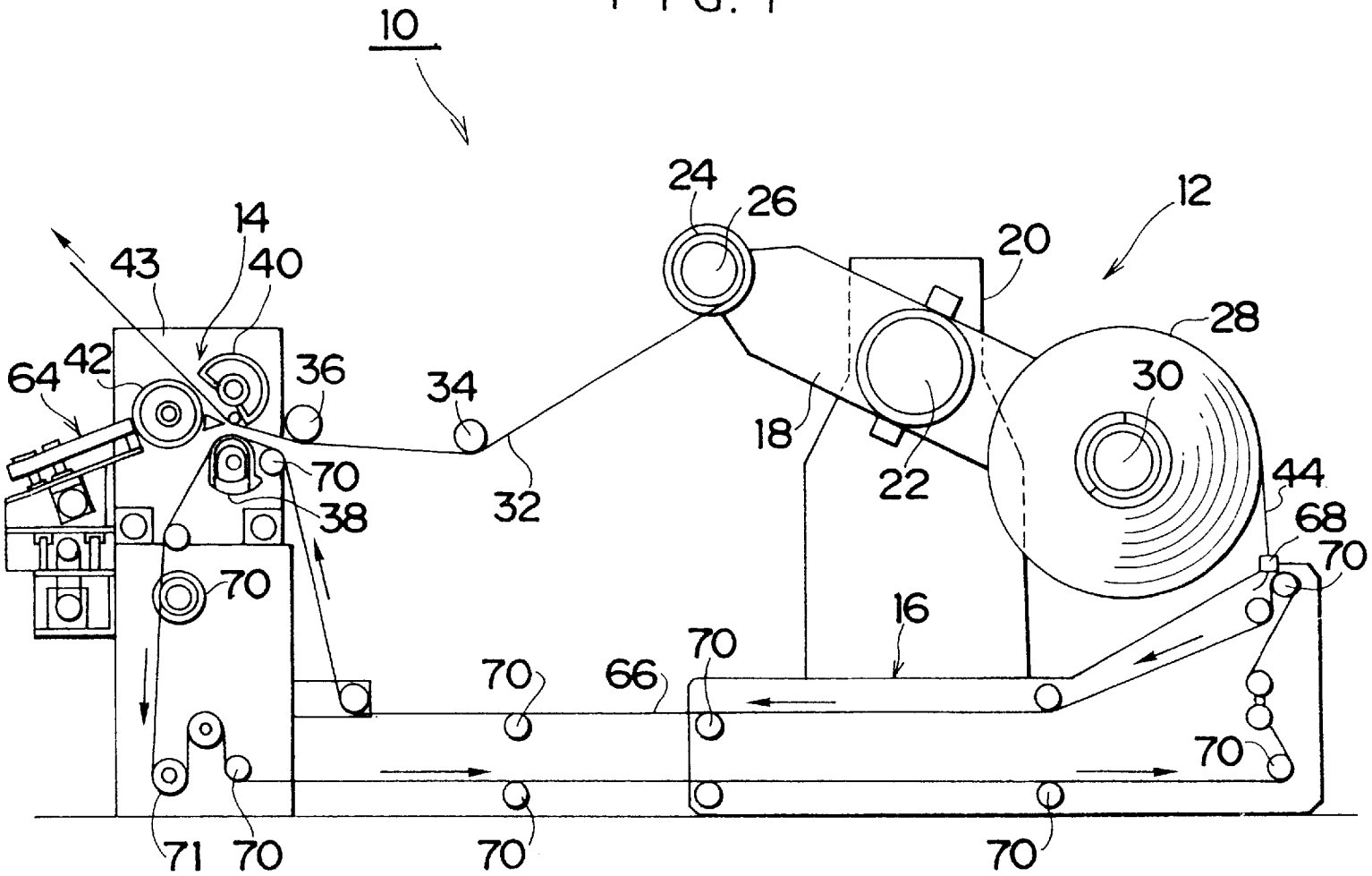
FIG. 1 is a front view of a splicing apparatus for splicing webs according to an embodiment of the present invention.

FIG. 1 illustrates a web splicing apparatus of the present invention applied to a web but splicing apparatus. As shown in FIG. 1, the splicing apparatus 10 consists of a turret 12, web cutting and splicing equipment 14, web transporting equipment 16, and splicing tape supply device 64.

The turret 12 has a turret arm 18, which is provided on a column 20 in such a manner as to be rotatable around a shaft 22. An old roll 24 which completes the unwinding of a web 32 is supported by one end of the turret arm 18 in such a manner as to be rotatable around a shaft 26. A new roll 28 which starts unwinding a web 44 is supported by the other end of the turret arm 18 in such a manner as to be rotatable around a shaft 30. The web 32 contacts on guide rollers 34 and 36 to reach the web cutting and splicing equipment 14.

Figure 2:
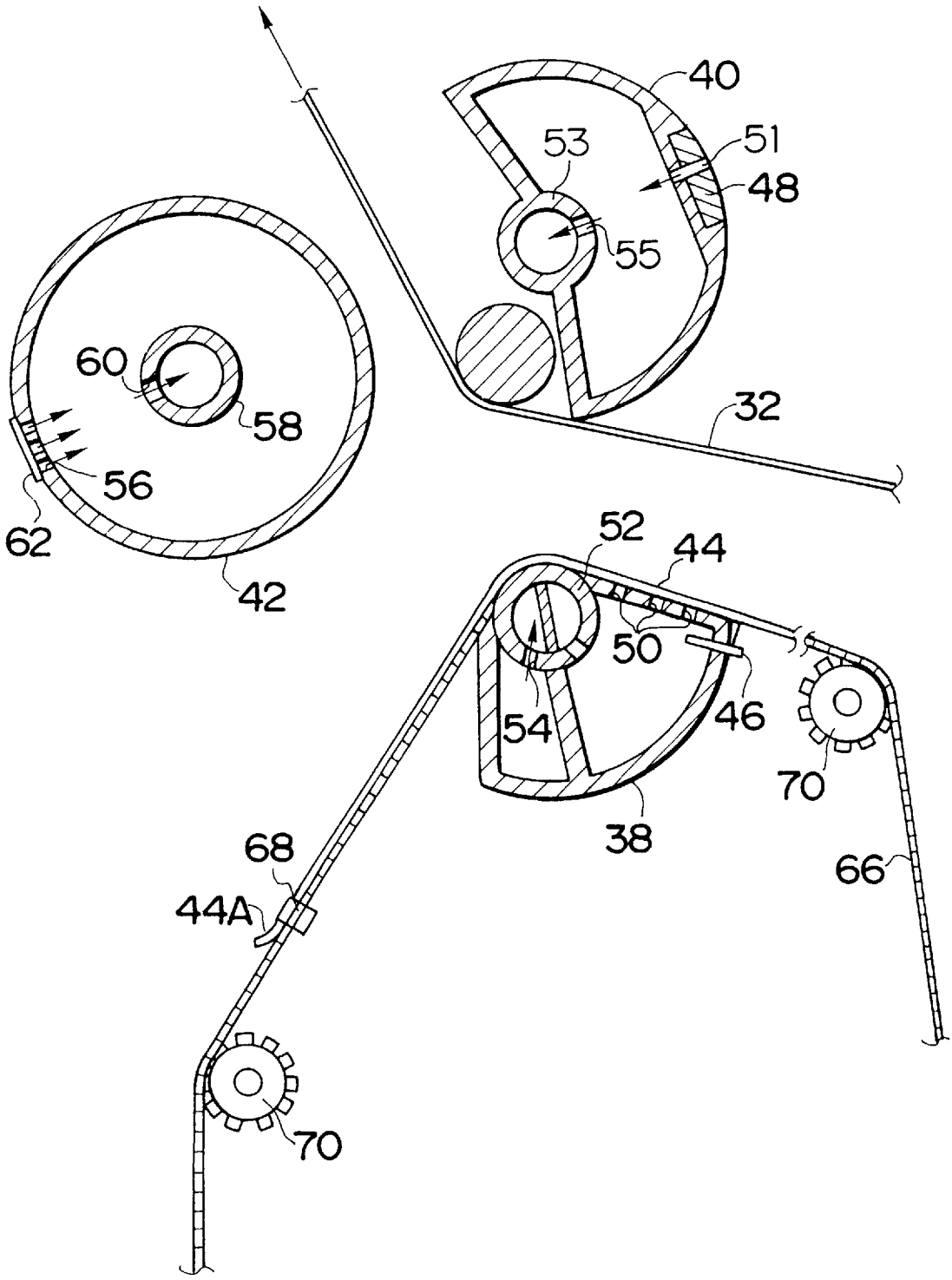
FIG. 2 is a view illustrating the construction of web cutting and splicing drums.

As shown in FIG. 2, the web cutting and splicing equipment 14 consists of a cutting drum 38, a cutting and splicing drum 40 and a splicing drum 42, all of which are provided on a frame 43 shown in FIG. 1. The drums 38, 40, 42 are rotated synchronously under power from a driving motor (not shown). The web 32 is inserted between the cutting drum 38 and the cutting and splicing drum 40 and the splicing drum 42, and then the web 32 is taken up by take-up equipment (not shown).

The web transporting equipment 16 transports the end of the web 44 from the new roll 28 to the web cutting and splicing equipment 14. Then, the web 44 clings onto the cutting drum 38 and waits in such a state that the preparations for splicing are complete as shown in FIG. 2.

Figure 3:
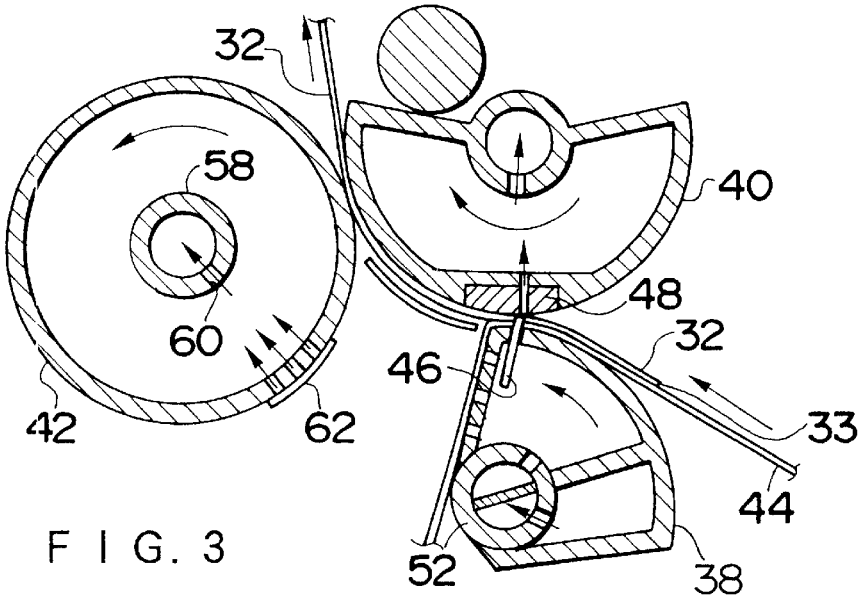
FIG. 3 is a view of assistance in explaining the operation of the web cutting and splicing drums.

In FIG. 2, a cutter 46 is attached to the cutting drum 38. As shown in FIG. 3, the cutter 46 cuts the stacked webs 32 and 44 on a cutting part 48 provided at the cutting and splicing drum 40. To improve the sharpness of the cutter 46, the cutter 46 is attached to the cutting drum 38 at a predetermined angle θ° with respect to the width direction of the web.

Figure 4:
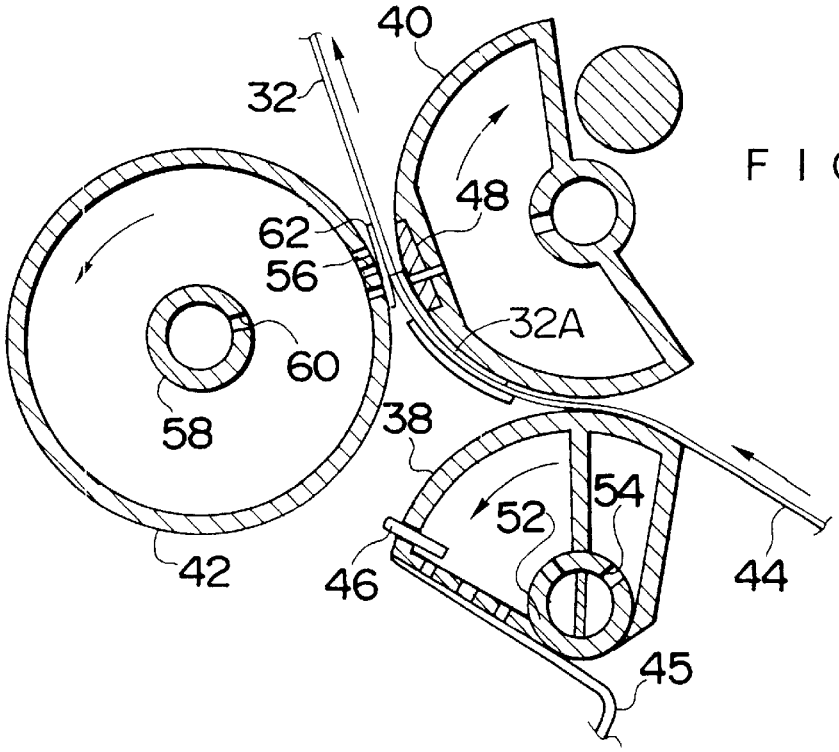
FIG. 4 is a view of assistance in explaining the operation of the web cutting and splicing drums.

Air holes 50, 50, . . . are formed on the flat surface of the cutting drum 38, and the air holes 50, 50, . . . connect with an air hole 54 formed on a rotary hollow shaft 52. The rotary hollow shaft 52 connects to a suction system and a blow system (not shown). When the suction system is driven, an area in a proximity to the end of the web 44 fixes onto the air holes 50, 50, . . . , and when the blow system is driven, a scrap 45 from the web 44 in FIG. 4 is removed from the cutting drum 38.

An air hole 51 is formed at the cutting and splicing drum 40. The air hole 51 connects with an air hole 55 formed on a rotary hollow shaft 53, which connects to the suction system and the blow system (not shown). When the suction system is driven, an area in a proximity to the end of the web 32 fixes onto the air hole 51, and when the blow system is driven, a scrap 32A from the web 32 in FIG. 4 is removed from the cutting and splicing drum 40.

A suction hole 56 is formed at the splicing drum 42. The suction hole 56 connects with an air hole 60 formed on a rotary hollow shaft 58, which connects to a suction system (not shown). When the suction system is driven, splicing tape 62 fixes onto the suction hole 56. The splicing tape 62 is supplied from the splicing tape supply device 64 shown in FIG. 1. The splicing tape supply device 64 will be described later.

Figure 5:
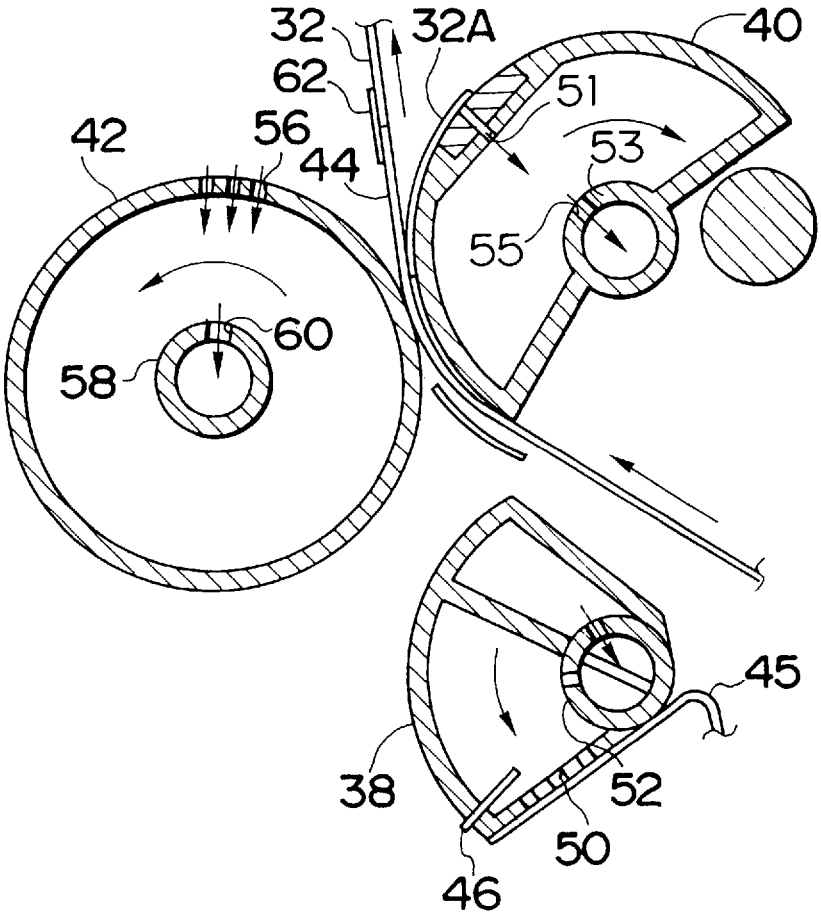
FIG. 5 is a view of assistance in explaining the operation of the web cutting and splicing drums.

The web cutting and splicing equipment 14 is controlled so as to drive when the rear end 33 of the web 32 (see FIG. 3) moves from the old roll 24 to the cutting and splicing equipment 14. That is, the drums 38, 40, 42 are driven in the direction indicated by arrows in FIG. 3, and the cutter 46 of the cutting drum 38, the cutting part 48 of the cutting and splicing drum 40, and the webs 32 and 44 are stacked to cut the webs 32 and 44. Then, as shown in FIG. 4, the area in a proximity to the rear end of the web 32 is spliced to the leading end of the web 44 with the splicing tape 62, and the splicing tape 62 is pressed between the cutting and splicing drum 40 and the splicing drum 42. Thereby, the trailing end of the web 32 and the leading end of the web 44 are butted together and spliced with the splicing tape 62 as shown in FIG. 5. Thus, the webs 32 and 44 can be continuously unwound while the web is supplied.

Figure 6:
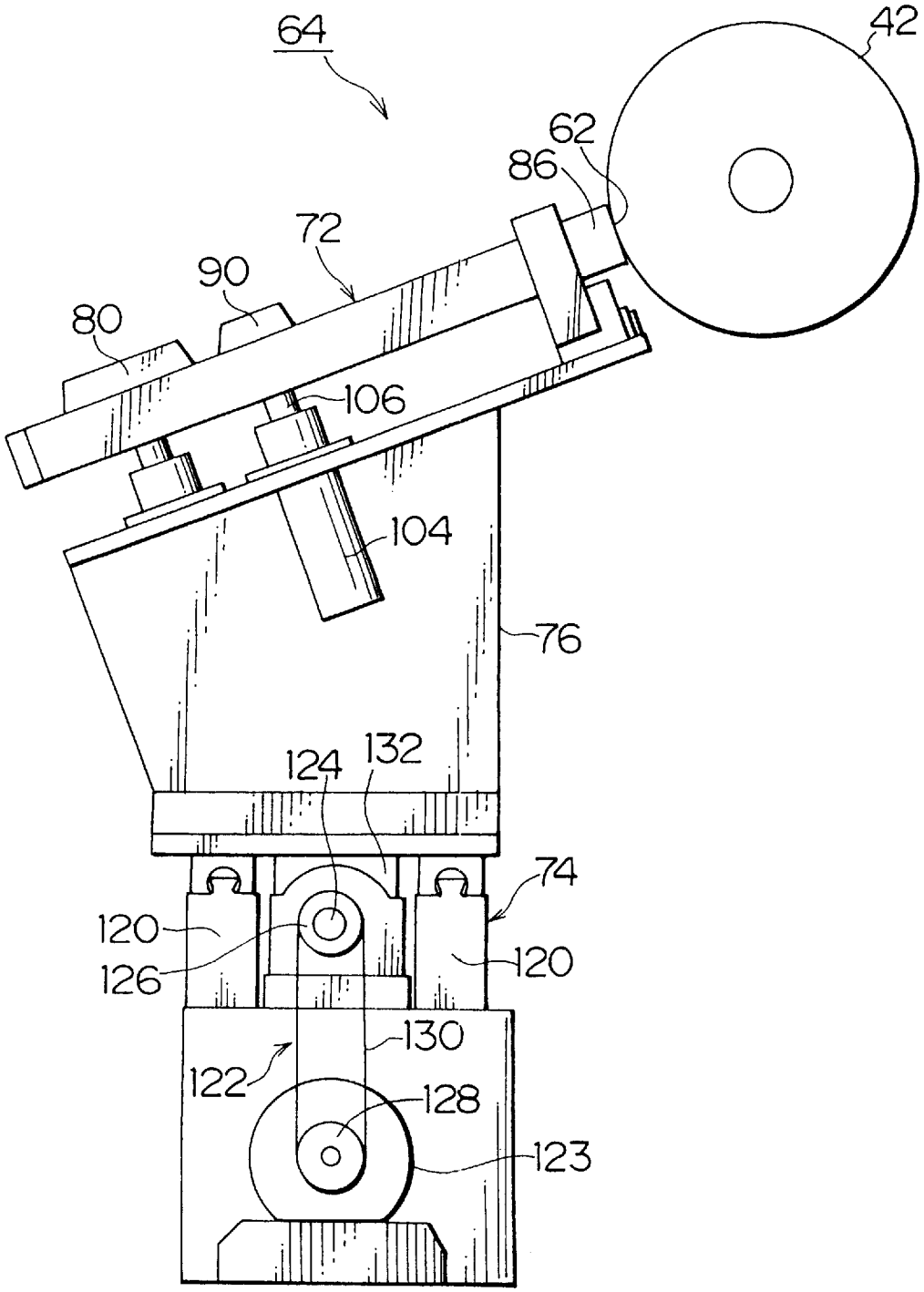
FIG. 6 is a side view illustrating an embodiment for splicing tape supply device.

As shown in FIG.6, the splicing tape supply device 64 consists of a main body 72 of a supply part for supplying the splicing tape 62 to the splicing drum 42, and a moving mechanism 74 for moving the main body 72 in the longitudinal direction of the splicing drum 42. The main body 72 of the supply part is fixed on a support base 76, and the main body 72 is inclined to the upper right. The support base 76 is supported by the moving mechanism 74.

Figure 7:
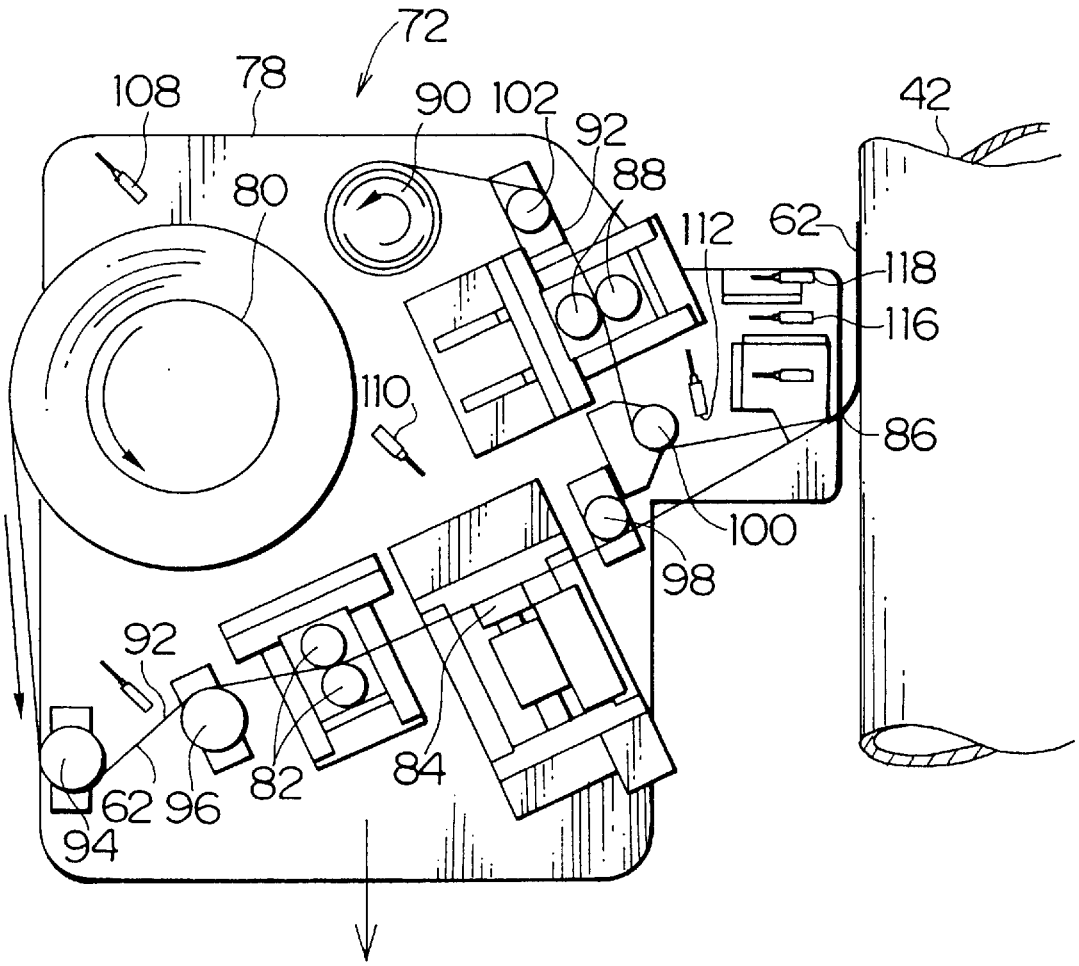
FIG. 7 is a top view of the splicing tape supply device in FIG. 6.

FIG. 7 is a top view of the main body 72 of the supply part. As indicated in FIG. 7, the main body 72 consists of a reel 80, feed rollers 82, a cutter 84, a peel plate 86, take-up rollers 88, and a take-up reel 90, all of which are provided on a base plate 78. A separator 92 is put on an adhesion surface of the splicing tape 62, and the splicing tape 62 is wound around the reel 80.

The splicing tape 62 and the separator 92 are brought to the take-up reel 90 from the reel 80 via guide rollers 94, 96, the feed rollers 82, the cutter 84, a guide roller 98, the peel plate 86, a guide roller 100, the take-up rollers 88, and a pass roller 102. The ends of the splicing tape 62 and the separator 92 are fixed to the take-up reel 90. A brake mechanism (not shown) is provided in the reel 80, and a take-up power generating mechanism (not shown) connects to the take-up reel 90. The feed rollers 82 connect to a spindle 106 of a servomotor 104 shown in FIG. 6. The take-up rollers 88 connect to a belt for transmitting the rotation of the feed rollers 82, or connect to the second servomotor. Thus, if the servomotor 104 is rotated in a take-up direction (a direction indicated by an arrow in FIG. 7), the splicing tape 62 and the separator 92 can be transported under a desired tensile force.

Next, an explanation will be given about the preparation procedure after a new coil of the splicing tape 62 is set in the reel 80. The ends of the splicing tape 62 and the separator 92 wound around the new coil are fixed to the take-up reel 90, and only the splicing tape 62 is cut by the cutter 84. Thefeed rollers 82, the take-up rollers 88 and the take-up reel 90 are operated until the front end of the cut splicing tape 62 reaches the peel plate 86. Thus, the preparations are completed.

In FIG. 7, a plurality of sensors are provided on the base plate 78. A sensor 110 is a light sensor for receiving light which is projected from a light projector 108. The sensor 110 detects the residual amount of the splicing tape 62 which is wound around the reel 80. A sensor 112 is a sensor for detecting the poor peeling. A sensor 116 detects the wrinkles on the splicing tape 62 which is supplied on the splicing drum 42, and a sensor 118 detects the position of the splicing tape 62.

Figure 8:
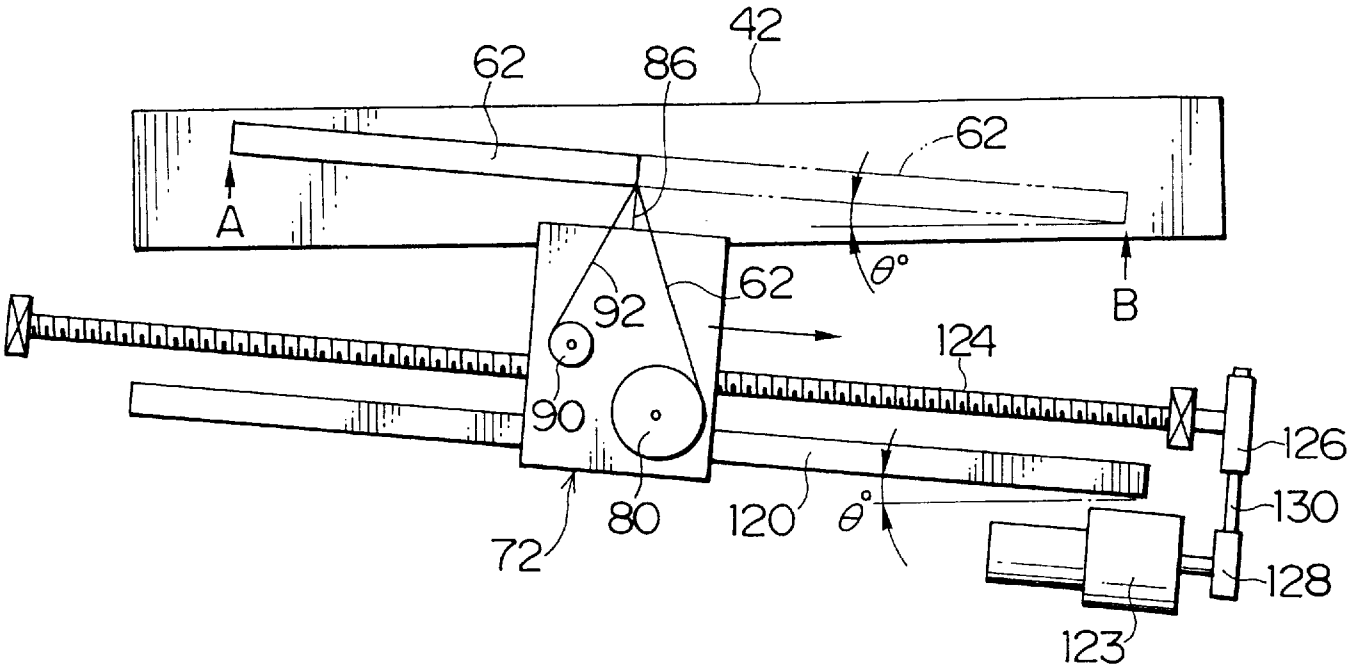
FIG. 8 is a view conceptionally describing the operation of the splicing tape supply device in FIG. 6.

On the other hand, referring to FIG. 6, the moving mechanism 74 consists of a pair of rails 120, 120 and screw feeding equipment 122. The pair of rails 120, 120 are inclined θ° with respect to the longitudinal direction of the splicing drum 42 as indicated in FIG. 8. The main body 72 of the supply part is movably supported on the pair of rails 120, 120. The angle of inclination θ° is equal to the angle of inclination of the cutting line between the web ends which are cut by the cutter 46 (see FIG. 3), and the rails 120 are inclined in the same direction as the cutting line. For this reason, when the main body 72 of the supply part moves along the rails 120, 120 in the direction indicated by an arrow in FIG. 8, the splicing tape 62 is supplied on the splicing drum 42 at the angle of θ° which is equal to the angle of inclination of the cutting line between the web ends.

The screw feeding equipment 122 has a screw rod 124 which is rotated by a servomotor 123. A driving force is transmitted from a pulley 128 of the servomotor 123 to a pulley 126, which is connected to the screw rod 124 via a belt 130. The screw rod 124 is arranged parallel to the rails 120 as indicated in FIG. 8, and a nut 132 provided at the bottom of the support base 76 shown in FIG. 6 is engaged with the screw rod 124. Thereby, if the servomotor 123 is driven, the screw rod 124 rotates so that the main body 72 of the supply part can move back and forth along the rails 120, 120.

Next, an explanation will be given about the operation of the splicing tape supply equipment 64, which is constructed in the above-mentioned manner.

Referring to FIG. 8, the servomotor 123 is driven backward so as to move the main body 72 of the supply part to the left in the drawing, so that the peel plate 86 of the main body 72 can be positioned at a supply start position indicated as A in the drawing. Next, the servomotor 104 (see FIG. 6) of the main body 72 of the supply part is driven, and the servomotor 104 is stopped when the front end of the splicing tape 62 which is cut by the cutter 84 reaches the peel plate 86. Thus, the preparations for supplying the splicing tape 62 are completed.

Then, the servomotor 123 is driven forward to move the main body 72 of the supply part to the right in the drawing, and the servomotor 104 (see FIG. 6) of the main body 72 is driven so as to supply the splicing tape 62 on the splicing drum 42 along the trajectory of the main body 72. Thereby, the splicing tape 62 is supplied at the angle of inclination θ° with respect to the longitudinal direction of the splicing drum 42 as shown in FIG. 8. Then, the cutter 84 is driven so as to position the end of the splicing tape 62 at a supply complete position indicated as B in the drawing, and then only the splicing tape 62 is cut. Thus, the splicing tape 62 is supplied on the splicing drum 42, and the preparations for splicing the webs are completed.

Thereafter, the servomotor 123 is driven backward to move the main body 72 of the supply part to the supply start position indicated as A in the drawing. The sensor 116 detects the wrinkles on the splicing tape 62, and the sensor 118 detects the position of the splicing tape 62. If there is something wrong, the sensors 116, 118 warns an operator by a warning means (not shown).

Figure 9:
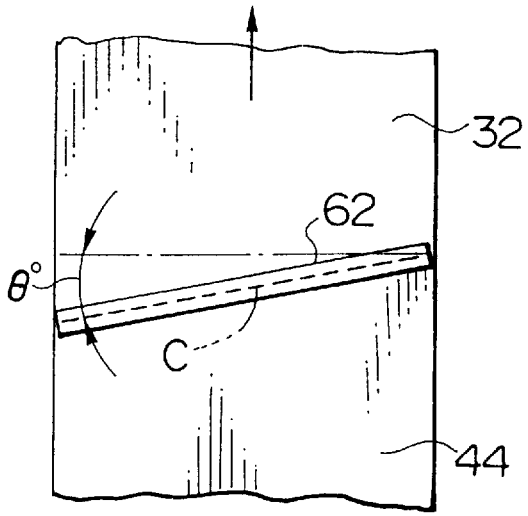
FIG. 9 is a view of assistance in explaining the web ends which are spliced together with splicing tape.

At the start of splicing the webs 32 and 44 as shown in FIG. 3, the trailing end of the web 32 and the leading end of the web 44, which are cut by the cutter 46, are spliced together with the splicing tape 62 as shown in FIG. 4. In this case, the splicing tape 62 is supplied on the splicing drum 42 at the angle of inclination equal to that of the cutting line between the two ends of the webs 32 and 44, and the splicing tape 62 is inclined in the same direction as the cut parts. For this reason, the splicing tape 62 is put along a cutting line C between the ends of the webs 32 and 44 as shown in FIG. 9.

Thus, the two ends of the webs 32 and 44, which are cut at a predetermined angle of inclination, are spliced together without developing the wrinkles on the ends of the webs 32 and 44 and the splicing tape 62.

Figure 10:
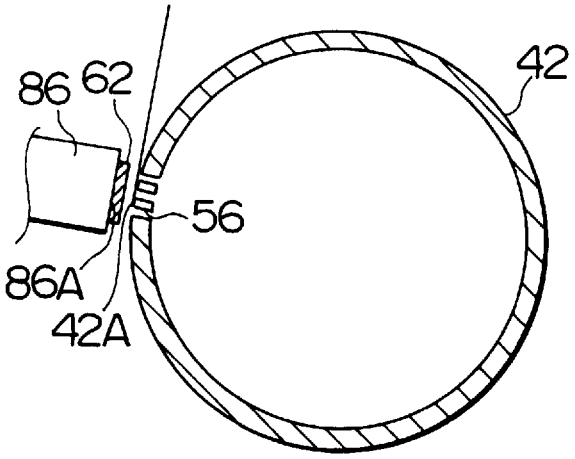
FIG. 10 is a side sectional view describing the relation between the splicing tape supply device and a cutting drum at the starting point.
Figure 11:
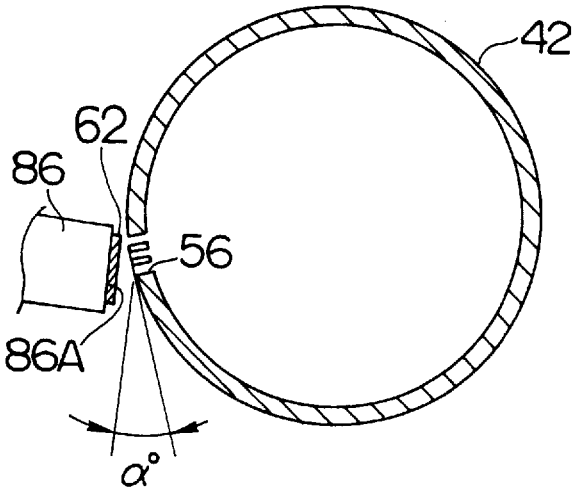
FIG. 11 is a side sectional view describing the relation between the splicing tape supply device and the cutting drum at the finishing point.
Figure 12:
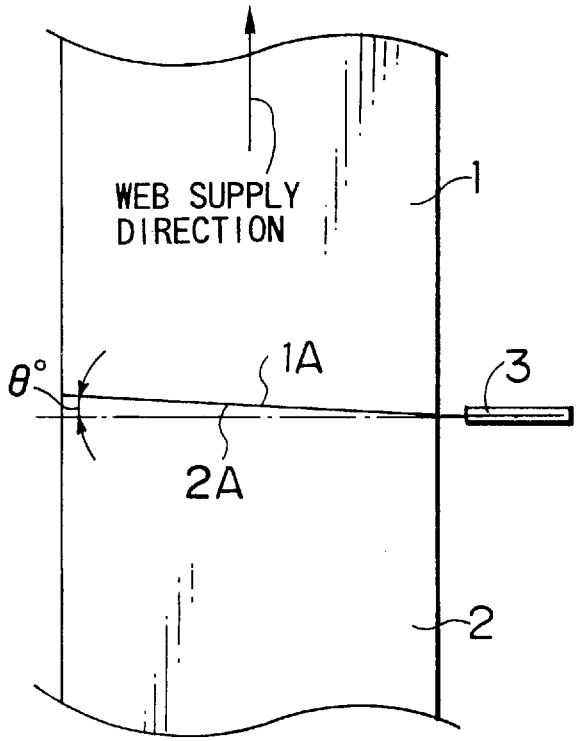
FIG. 12 PRIOR ART
FIG. 12 is a view of assistance in explaining the web ends which are cut by a cutter in prior art.
Figure 13:
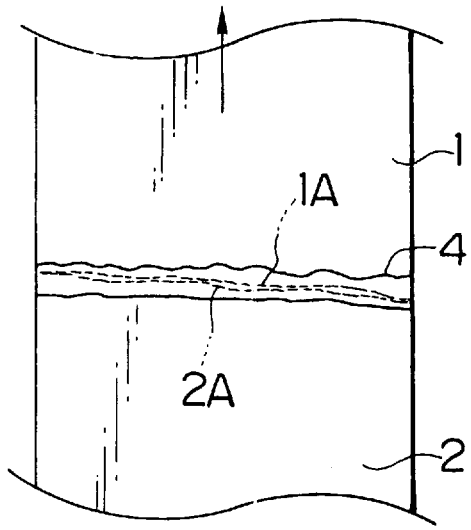
FIG. 13 PRIOR ART
FIG. 13 is a view of assistance in explaining the web ends which are spliced together by the conventional apparatus.

The main body 72 of the supply part is favorably moved parallel to the suction surface of the splicing drum 42 in order that the splicing tape 62 can be supplied without wrinkling on the splicing drum 42. According to this embodiment, however, the splicing drum 42 is cylindrical. Therefore, for example, a surface 86A of the peel plate 86 is set parallel to the suction surface 42A of the splicing drum 42 at the supply start position of the splicing tape 62 shown in FIG. 10, the parallelism is lost as the main body 72 of the supply part moves toward the supply complete position. When the main body 72 reaches the supply complete position, the surface 86A shifts α° for example with respect to the suction surface 42A of the splicing drum 42 as indicated in FIG. 11. That is, the splicing tape 62 may wrinkle because of the shift. On the other hand, if a speed (B) at which the servomotor 104 supplies the splicing tape 62 is higher than a speed (A) at which the servomotor 123 moves the main body 72 of the supply part, the splicing tape 62 wrinkles.

Thus, in this embodiment, the surface 86A of the peel plate 86 is set parallel to the suction surface 42A of the splicing drum 42 at the supply complete position of the splicing tape 62. That is because other steps to prevent the wrinkling are not available at the supply complete position whereas the wrinkling can be prevented at the supply start position of the splicing tape 62 by controlling the ratio between the speed (A) at which the servomotor 123 moves the main body 72 of the supply part and the speed (B) at which the servomotor 104 supplies the splicing tape 62. The speed (B) at which the servomotor 104 supplies the splicing tape 62 is set lower than the speed (A) at which the servomotor 123 moves the main body 72 of the supply part so that the splicing tape 62 is supplied under a tensile force. Thereby, the wrinkling of the splicing tape 62 can be prevented. The relation between the speeds (A) and (B) is A>B from the supply start position to the intermediate position of the splicing tape 62, and A=B from the intermediate position to the supply complete position. Thereby, the splicing tape 62 can be satisfactorily supplied on the splicing drum 42 without wrinkling.

Next, an explanation will be given about the web transporting equipment 16.

As depicted in FIG. 1, the web transporting equipment 16 consists of circulating equipment for circulating loop chains 66, 66 as moving means (the chain on one side is not shown), and a hold member 68 connected to the chains 66, 66.

The chains 66, 66 are arranged at intervals wider than the width of the web 44. The chains 66, 66 are moved round via a plurality of sprockets 70, 70 . . . in a direction indicated by an arrow in the drawing so as to move the hold member 68 within the limit from the lower position of the new roll 28 to the splicing position of the web cutting and splicing equipment 14. Reference numeral 71 is a sprocket for driving the chain 66, and the sprocket 71 is placed on the frame 43.

Figure 14:
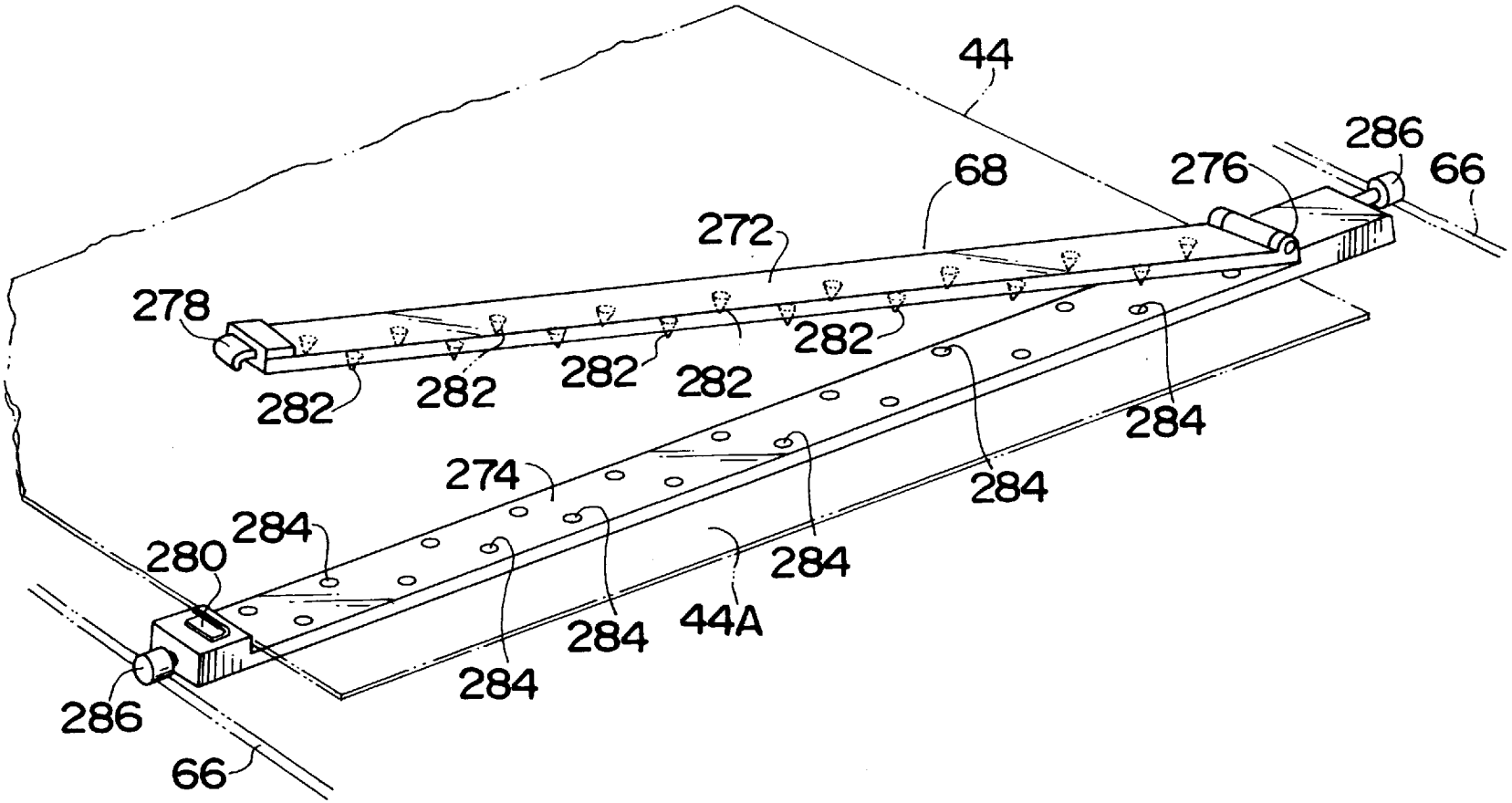
FIG. 14 is a perspective view illustrating the first embodiment for a web hold member.
Figure 15:
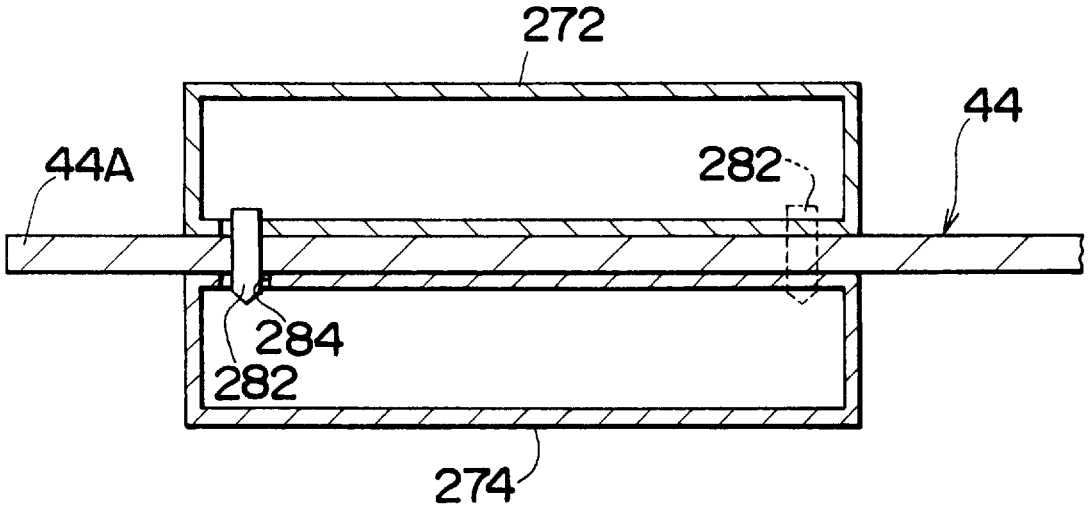
FIG. 15 is a sectional view of the web hold member in FIG. 14.

As shown in FIG. 14, the hold member 68 is composed of two rectangular plates 272 and 274. The plates 272 and 274 are wider than the width of the web 44, and they can pinch the end 44A of the web 44 all over the width. The plate 272 is openably connected at one end thereof to the plate 274 via a hinge 276, and a pawl 278 is provided at the other end of the plate 272. When the plate 272 is closed, the pawl 278 catches on a hook 280 provided on the plate 272. Thereby, the plates 272 and 274 are fixed in the closed state. A plurality of pins 282, 282 . . . are crossly provided on the inner surface of the plate 272, and holes 284, 284 . . . are formed on the inner surface of the plate 274 correspondingly to the pins 282. The pins 282 are inserted into the holes 284. When the web 44 is pinched between the plates 272 and 274, the pins 282 bite on the web 44 as shown in FIG. 15, and the web 44 can be prevented from slipping between the plates 272 and 274. In FIG. 14, reference numerals 286 are connecting members for connecting the plate 274 to the chains 66, 66.

An explanation will be given about the operation of the web transporting equipment 16, which is constructed in the above-mentioned manner. First, the chains 66, 66 of the transporting equipment 16 are circulated, and the plates 272 and 274 are positioned below the new roll 28 as shown in FIG. 1. Next, the leading end 44A of the web 44 is unwound by a predetermined amount from the new roll 28. Then, the plate 272 is opened as shown in FIG. 14, and the end 44A of the web 44 is inserted between the plates 272 and 274. Then, the plate 272 is closed, and the pawl 278 catches on the hook 282, and the web 44 is pinched over its width between the plates 272 and 274. Thus, the preparations for transporting the web 44 are completed.

Next, the chains 66, 66 are circulated to move the plates 272 and 274. Thereby, the web 44 is unwound from the new roll 28, and the chains 66, 66 stop moving when the end 44A of the web 44 reaches the splicing position of the web cutting and splicing equipment 14, that is, the position indicated in FIG. 2. Thereafter, the web 44 waits in a state that the preparations for splicing the webs are complete.

As stated above, since the end of the web 44 is pinched all over the width between the plates 272 and 274 while the web 44 is transported, the web 44 can be held tightly. The pins 282 can prevent the web 44 from slipping, and the web 44 is fixed between the plates 272 and 274. Thus, in this embodiment, the web 44 can be smoothly transported to the splicing position without slipping from the plates 272 and 274.

Figure 16:
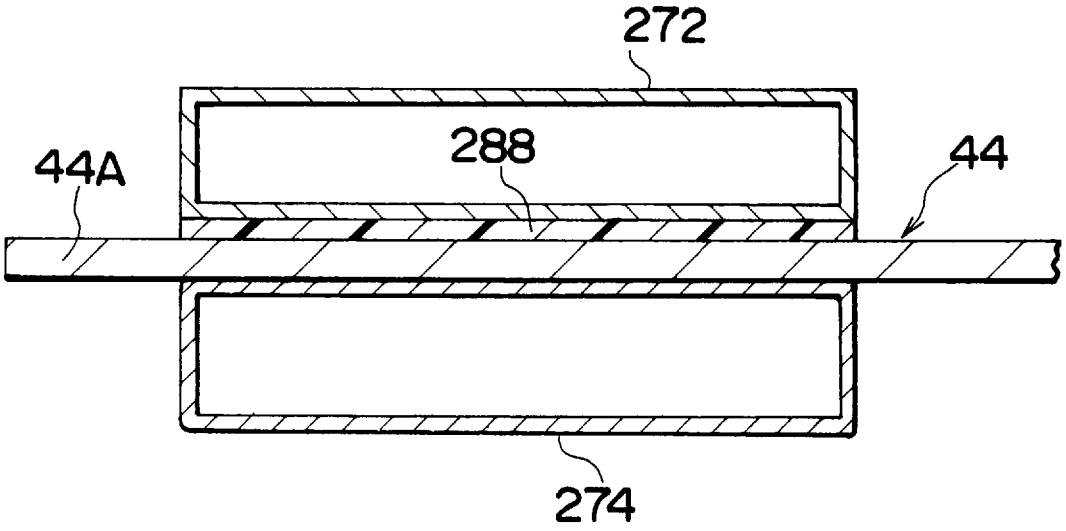
FIG. 16 is a sectional view illustrating the second embodiment for the web hold member.

FIG. 16 is a sectional view illustrating the second embodiment of the hold member. The plates 272 and 274 have no pin 282 and hole 284 shown in FIG. 14, and a nonslip rubber sheet 288 is provided on the inside surface of the plate 272. Thereby, the web 44 can be prevented from slipping due to the rubber sheet 288 while the web 44 is pinched. The rubber sheet 288 may be provided on the plate 274.

Figure 17:
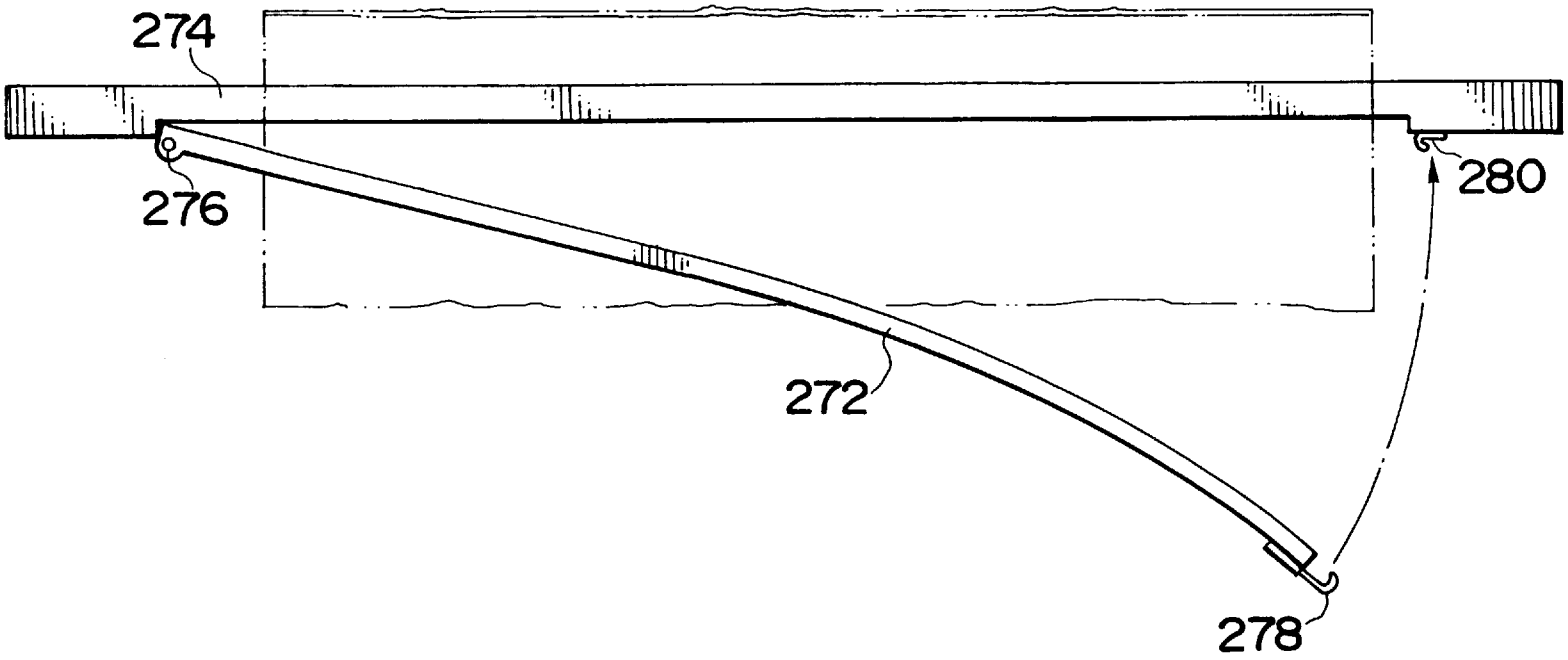
FIG. 17 is a view of assistance in explaining the third embodiment of the web hold member.

FIG. 17 is a front view illustrating the third embodiment of the hold member. The plate 272 of the hold member in FIG. 17 is curved. When the web 44 is pinched between the plates 272 and 274, the plate 272 is elastically deformed to be straight. Thus, the web 44 can be fixed without slipping due to a restitutive force of the plate 272 (a counterforce from the plate 272). The plate 274 may also be curved.

Figure 18:
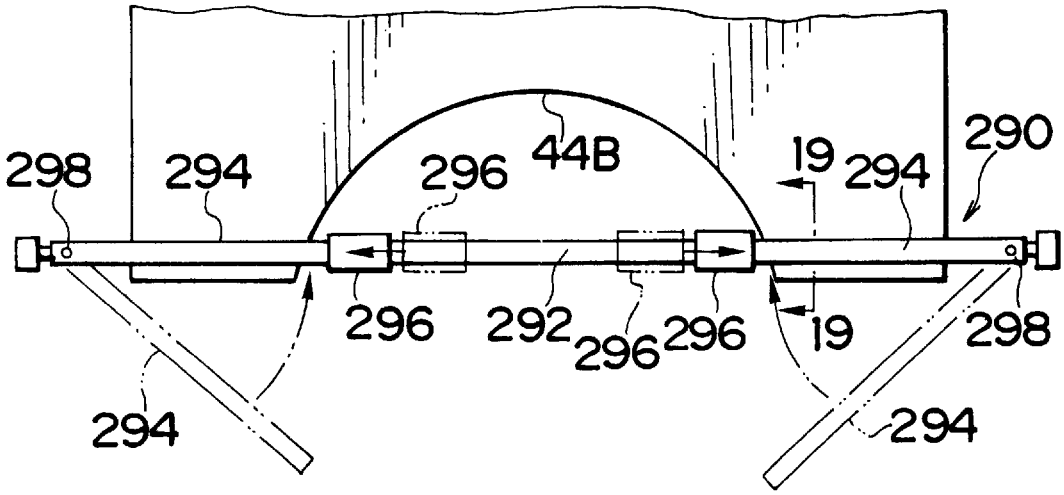
FIG. 18 is a view of assistance in explaining the fourth embodiment of the web hold member.
Figure 19:
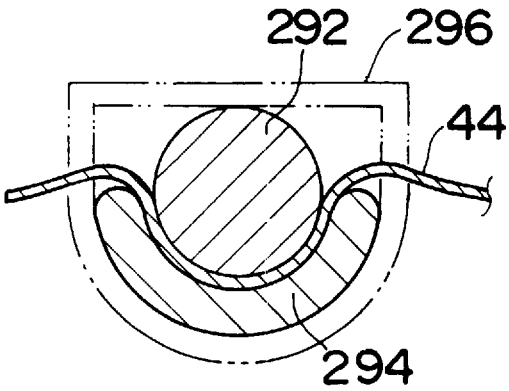
FIG. 19 is a sectional view taken along line 19—19 in FIG. 18.

FIG. 18 is a front view illustrating the fourth embodiment of the hold member, and FIG. 19 is a sectional view taken along a line 19—19 in FIG. 18. A hold member 290 in this embodiment can be effectively used for the web 44 in which a central part 44B of the end 44A is cut in a semicircular arc as shown in FIG. 18.

As shown in FIGS. 18 and 19, the hold member 290 consists of a round bar 292, a pair of plates 294, 294 whose inner surfaces are semicylindric, and fixing rings 296, 296. The round bar 292 is longer than the width of the end of the web 44. The pair of the plates 294, 294 are openably connected to both ends of the round bar 292 via hinges 298, 298. The plates 294, 294 pinch the web 44 between themselves and the round bar 292 when they are closed as shown in FIG. 19. Since the pair of plates 294, 294 are shorter than the round bar 292, the space for opening and closing the pair of plates 294, 294 can be small, and the trouble can be reduced.

As set fourth hereinabove, according to the web splicing apparatus of the present invention, the splicing tape supply means supplies the splicing tape to the splicing means at the angle of inclination corresponding to the cutting line between two ends of the webs cut by the cutting means. Thereby, the two ends of the webs, which are cut at a predetermined angle of inclination, can be satisfactorily spliced together.

Furthermore, in the present invention, the leading end of the web of the new roll is transported to the splicing position while the end of the web of the new roll is pinched over its width by the hold member, and thereby the web can be pinched tightly. Thus, in the present invention, the web can be transported without slipping from the hold member and the transporting position, so that the end of the web can be smoothly transported from the new roll to the splicing position without fail.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. A web splicing apparatus for splicing webs, comprising:

turret means for pivotally supporting an old roll from which one of said webs is unwound and a new roll from which the other of said webs starts to be unwound;

cutting means for concurrently cutting a trailing end of said web of said old roll and a leading end of said web of said new roll at a non-zero predetermined angle of inclination with respect to a width direction of said webs;

splicing means for splicing, with splicing tape, said ends of said webs, subsequent to said ends being cut by said cutting means, along a cutting line between said ends of said webs corresponding to said non-zero predetermined angle of inclination; and splicing tape supply means for supplying said splicing tape to said splicing means at an angle of inclination corresponding to said cutting line between said ends of said webs.

2. The web splicing apparatus for splicing webs as defined in claim 1, wherein said splicing tape supply means comprises:

a main body for supplying said splicing tape to said splicing means; and a moving mechanism for moving said main body at said angle of inclination.

3. The web splicing apparatus for splicing webs as defined in claim 2, wherein said moving mechanism of said splicing tape supply means comprises:

a rail for movably supporting said main body at said angle of inclination; and driving means for moving said main body along said rail.

4. The web splicing apparatus for splicing webs as defined in claim 3, wherein said driving means of said splicing tape supply means is screw feeding equipment.

5. The web splicing apparatus for splicing webs as defined in claim 1, further comprising:

transporting means for transporting said leading end of said web of said new roll from said turret means to a splicing position of said splicing means, said transporting means comprising a hold member for pinching said end of said web of said new roll over its width, and moving means for moving said hold member from said turret means to said splicing position of said splicing means.

6. The web splicing apparatus for splicing webs as defined in claim 5, wherein said hold member is provided with a plurality of pins biting into said end of said web.

7. The web splicing apparatus for splicing webs as defined in claim 5, wherein said hold member comprises a first pinch member being longer than the width of said end of said web, and a pair of second pinch members being openably connected to both ends of said first pinch member, said hold member pinching said end of said web between said first pinch member and said pair of second pinch members, said second pinch members, in a closed state, being fixed on said first pinch member by fixing members.

8. A web splicing apparatus for splicing webs, comprising:

turret means for pivotally supporting an old roll from which one of said webs is unwound and a new roll from which the other of said webs starts to be unwound;

cutting means for cutting a trailing end of said web of said old roll and a leading end of said web of said new roll at a predetermined angle of inclination with respect to a width direction of said webs;

splicing means for splicing, with splicing tape, said ends of said webs, which are cut by said cutting means, along a cutting line between said ends of said webs;

splicing tape supply means for supplying said splicing tape to said splicing means at an angle of inclination corresponding to said cutting line between said ends of said webs; and transporting means for transporting said leading end of said web of said new roll from said turret means to a splicing position of said splicing means, said transporting means comprising a hold member having two plates hingedly connected for pinching said end of said web of said new roll over its width, and moving means for moving said hold member from said turret means to said splicing position of said splicing means;

wherein at least one of said plates is provided with a plurality of pins biting into said end of said web.

* * * * *